US008256642B2

(12) United States Patent
McNamara et al.

(10) Patent No.: US 8,256,642 B2
(45) Date of Patent: Sep. 4, 2012

(54) SIPPY CUP ASSEMBLY

(75) Inventors: Conor McNamara, Montclair, NJ (US); Boris Kontorovich, Brooklyn, NY (US)

(73) Assignee: Helen of Troy Limited, St. Michael (BB)

( * ) Notice: Subject to any disclaimer, the term of this patent is extended or adjusted under 35 U.S.C. 154(b) by 363 days.

(21) Appl. No.: 12/557,117

(22) Filed: Sep. 10, 2009

(65) Prior Publication Data

US 2011/0056968 A1 Mar. 10, 2011

(51) Int. Cl.
*A61J 9/00* (2006.01)
*A61J 9/04* (2006.01)

(52) U.S. Cl. ..... 220/714; 220/703; 220/711; 220/713; 215/11.1; 215/11.5

(58) Field of Classification Search ..... 220/703, 220/711, 713, 714; 215/11.1, 11.5
See application file for complete search history.

(56) References Cited

U.S. PATENT DOCUMENTS

| | | | | |
|---|---|---|---|---|
| 5,890,620 | A | 4/1999 | Belcastro | |
| 6,050,445 | A | 4/2000 | Manganiello | |
| 6,264,166 | B1 * | 7/2001 | Bowland et al. | 251/144 |
| 6,269,968 | B1 | 8/2001 | Belcastro | |
| 6,321,931 | B1 | 11/2001 | Hakim et al. | |
| 6,357,620 | B1 | 3/2002 | Hakim | |
| 6,422,415 | B1 | 7/2002 | Manganiello | |
| 6,568,557 | B2 | 5/2003 | Fusco et al. | |
| 6,607,092 | B2 | 8/2003 | Manganiello et al. | |
| 6,732,882 | B2 | 5/2004 | Belcastro | |
| 6,758,364 | B1 | 7/2004 | Rohrig | |
| 6,786,352 | B2 | 9/2004 | Belcastro | |
| RE38,692 | E | 2/2005 | Wong | |
| 7,147,121 | B2 | 12/2006 | Boucher et al. | |
| 7,204,386 | B2 | 4/2007 | Hakim | |
| 2001/0020623 | A1 | 9/2001 | McDonough et al. | |
| 2004/0099674 | A1 | 5/2004 | McDonough et al. | |
| 2005/0072788 | A1 | 4/2005 | Lieberman et al. | |
| 2005/0205589 | A1 | 9/2005 | Davis et al. | |
| 2006/0037963 | A1 | 2/2006 | Pillado | |
| 2006/0151499 | A1 | 7/2006 | Lieberman et al. | |
| 2006/0261064 | A1 * | 11/2006 | Holley | 220/203.06 |
| 2007/0187419 | A1 | 8/2007 | Hakim | |
| 2008/0128438 | A1 | 6/2008 | Lane | |
| 2008/0173654 | A1 | 7/2008 | Hakim | |
| 2009/0020544 | A1 | 1/2009 | Yuen | |

* cited by examiner

*Primary Examiner* — Anthony Stashick
*Assistant Examiner* — Madison L Wright

(57) ABSTRACT

A sippy cup assembly including a valve insert having a sheath and a stabilizing core is disclosed. The sippy cup assembly generally includes a container, a lid releasably coupled to and enclosing the container, and an annular seal for preventing liquid from leaking out of the container. The valve insert maintains form while permitting repeated removal and insertion, in addition to washing and long-term use, by providing that the stabilizing core has a rigidity greater than that of the sheath formed over the stabilizing core. The valve insert may be installed in the lid to correspond with a spout and air exchange aperture to permit egress of liquid and ingress of air upon application of suction by a user. When no suction is applied to the spout, the valve insert prevents leakage of liquid from the container.

21 Claims, 7 Drawing Sheets

SIPPY CUP ASSEMBLY

TECHNICAL FIELD OF THE INVENTION

The present device relates to a sippy cup assembly having a valve insert for preventing accidental spillage but permitting outflow of liquid contained in the cup. Particularly, the present device relates to a removable valve insert having a stabilizing core embedded in an external sheath for providing structural support and durability to the valve insert.

BACKGROUND OF THE INVENTION

Recent advances in silicone technology have resulted in a variety of valve designs for children's sippy cups. Although many existing designs are effective in preventing the escape of liquid from a container without the application of negative pressure from a user, these valves are generally permanently installed in the cup, thereby reducing sanitation and longevity of the cup. Particularly when used by children or the infirmed, sterilization of all components of a cup is extremely important, but cannot be accomplished without each component's removal.

Permanent valve installations in such cups can cause mold and bacteria buildup, which can eventually pose significant risks to the user. Accordingly, cups having permanent valve installations may be used a limited number of times before customary cleaning techniques are no longer able to thoroughly sanitize the valve components, requiring the user to dispose of the cup. Such requisite disposal has obvious economic and environmental implications to the users and consumers generally, in addition to the significant distress disposal of a child's favorite cup can impose on familial relations.

When sippy cup designs provide for a removable valve assembly, however, the assembly is generally constructed of a single material that, while flexible, is generally easily torn with repeated extractions and insertions of the valve assembly. Given the repeated washings required for utensils and containers used by children, in particular, durability is a significant aspect for consumers of such products. Accordingly, existing valve assemblies fail to provide the removability—desirable from a sanitation perspective—and durability—preferable from an economic and environmental perspective—deemed necessary to modern consumers, and possible to manufacturers given new advances in overmolding processes.

There is disclosed herein an improved sippy cup assembly which avoids the disadvantages of prior devices while affording additional structural and operating advantages.

SUMMARY OF THE INVENTION

Generally, a sippy cup assembly for permitting flow of liquid upon application of a suctioning force and preventing unwanted leakage is disclosed and claimed. The sippy cup assembly comprises multiple components, including a lid assembly and a valve insert, the valve insert comprising a sheath with a first rigidity and a core with a second rigidity, the first rigidity being less than the second rigidity.

In one embodiment of the claimed sippy cup assembly, there is claimed a container to which a lid is releasably coupled, an annular seal being disposed between the lid and the container when the components are coupled. In an embodiment, the lid includes a spout and an air exchange aperture. An aspect of the embodiment includes disposing a valve insert within the lid, the valve insert having a sheath formed over a stabilizing core, where the stabilizing core has a greater rigidity than the sheath.

Another aspect of an embodiment includes the sheath comprising an outflow port, having a valve face defining a slit, and a stem, where the outflow port corresponds to the spout and the stem corresponds to the air exchange aperture. In an embodiment, the stabilizing core includes a tab extending from a base, and first and second arms extending in a direction opposite the tab and being disposed within the outflow port. An embodiment provides for the tab having a depression for easy grasping by a user. Yet another aspect of an embodiment provides that the inner surface of the lid may include a protuberance and the valve insert may include a corresponding bore, where the bore accepts the protuberance to secure the valve insert to the inner surface.

An aspect of an embodiment includes that the slit and stem of the sheath are responsive to a negative pressure such that liquid is permitted to flow out of the container and air may flow into the container.

It is an aspect of an embodiment that the stabilizing core is embedded within the sheath, and in an embodiment, the stabilizing core is embedded in the sheath through overmolding. Individual aspects of an embodiment provide for the sheath being silicone, the stabilizing core being nylon, the annular seal being silicone, and the lid being polypropylene, each aspect being applicable in combination with or individually from each of the other aspects.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
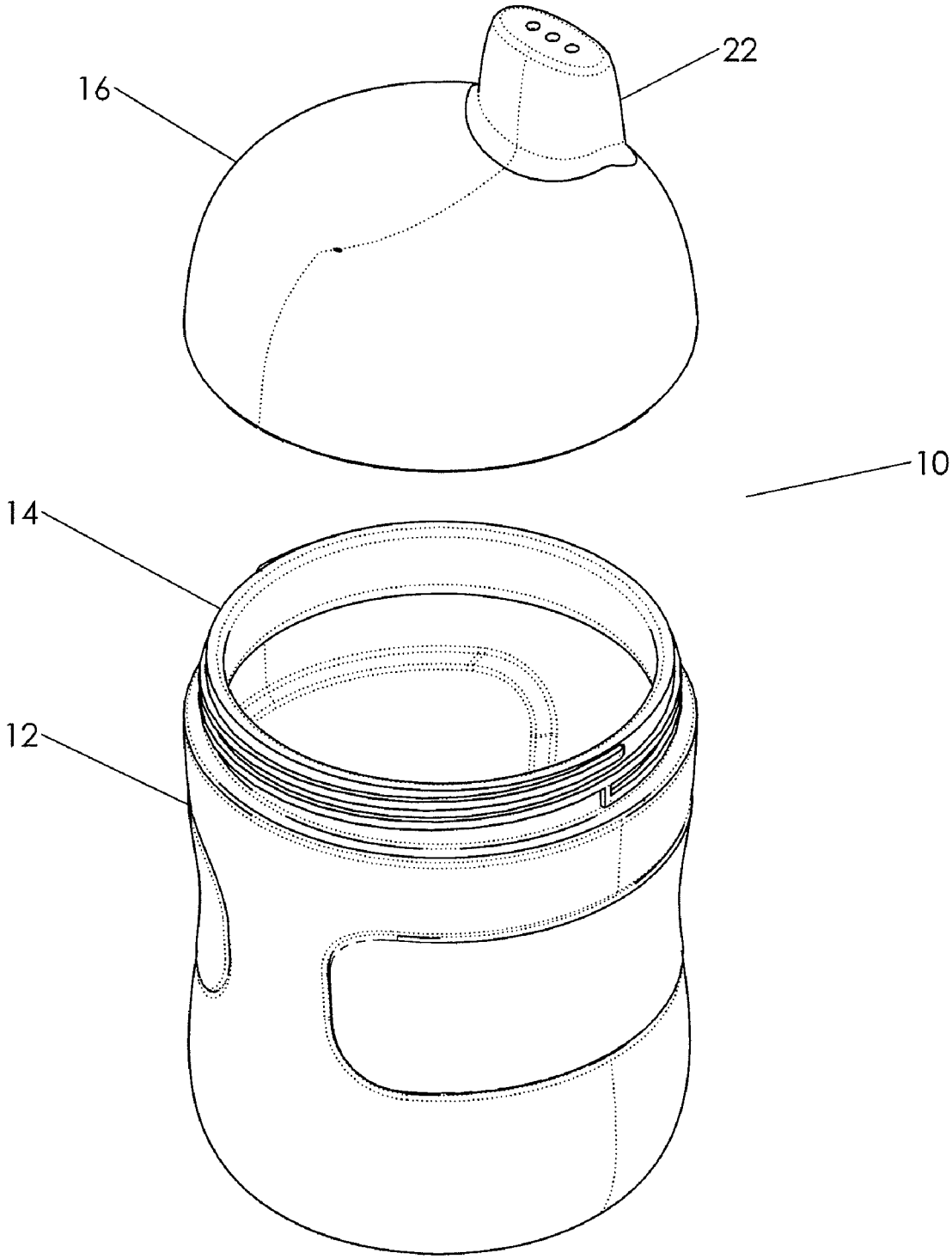
FIG. 1 is an exploded perspective view of an embodiment of the present sippy cup assembly.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

Referring to FIGS. 1-7, there is illustrated a sippy cup assembly, of which a sippy cup lid assembly and a sippy cup valve insert are part, generally designated by the numerals 10, 15, and 50, respectively. As illustrated in FIG. 1, the sippy cup assembly 10 most generally comprises a container 12 for retaining a liquid (not shown), a lid 16 enclosing an open end 14 of the container 12. FIGS. 1-4 depict the preferred manner in which lid 16 is releasably coupled to the open end 14 of the container 12, a valve insert 50 being nested within an inner surface 18 of the lid 16. Two components—an annular seal 26 and the valve insert 50—most clearly represented in FIG. 4, prevent the spillage of liquid from the container 12 through the lid 16 for ease of use by a child or an elderly user (not shown), and even for use by the general public for spill-and-worry-free transportation of the sippy cup assembly 10.

Figure 2:
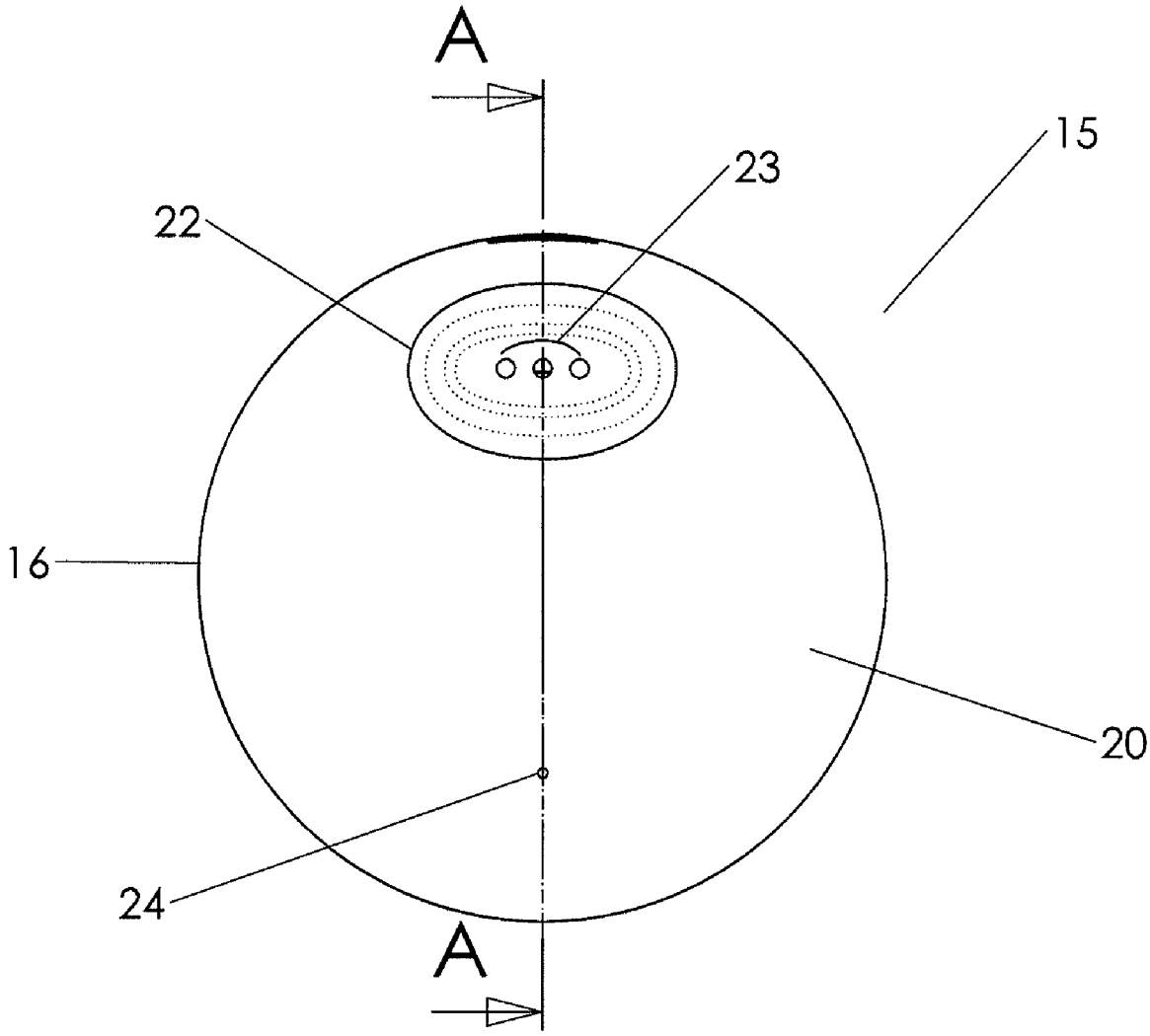
FIG. 2 is a top view of an embodiment of a lid assembly as illustrated in the embodiment of the sippy cup assembly in FIG. 1.
Figure 3:
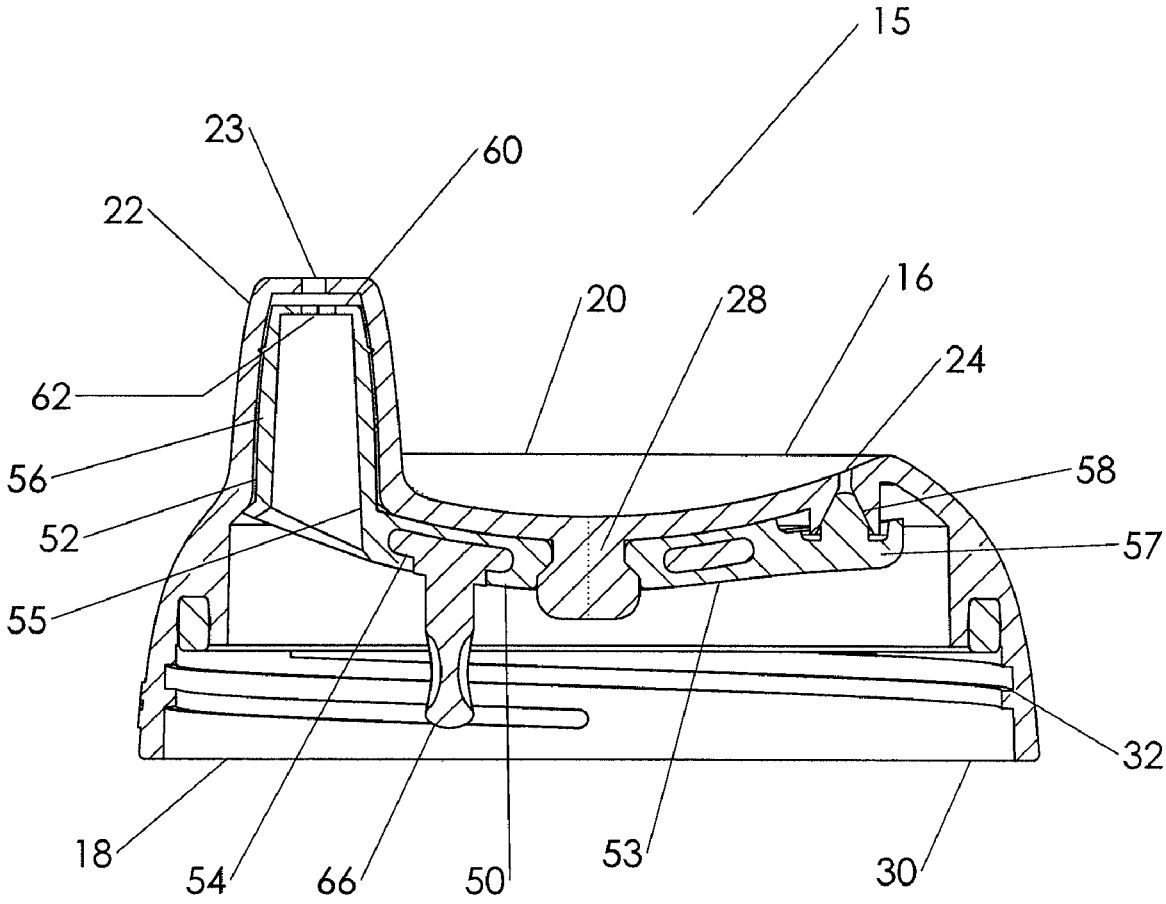
FIG. 3 is a cross-section of the embodiment of the lid assembly illustrated in FIG. 2 taken across line A-A.
Figure 4:
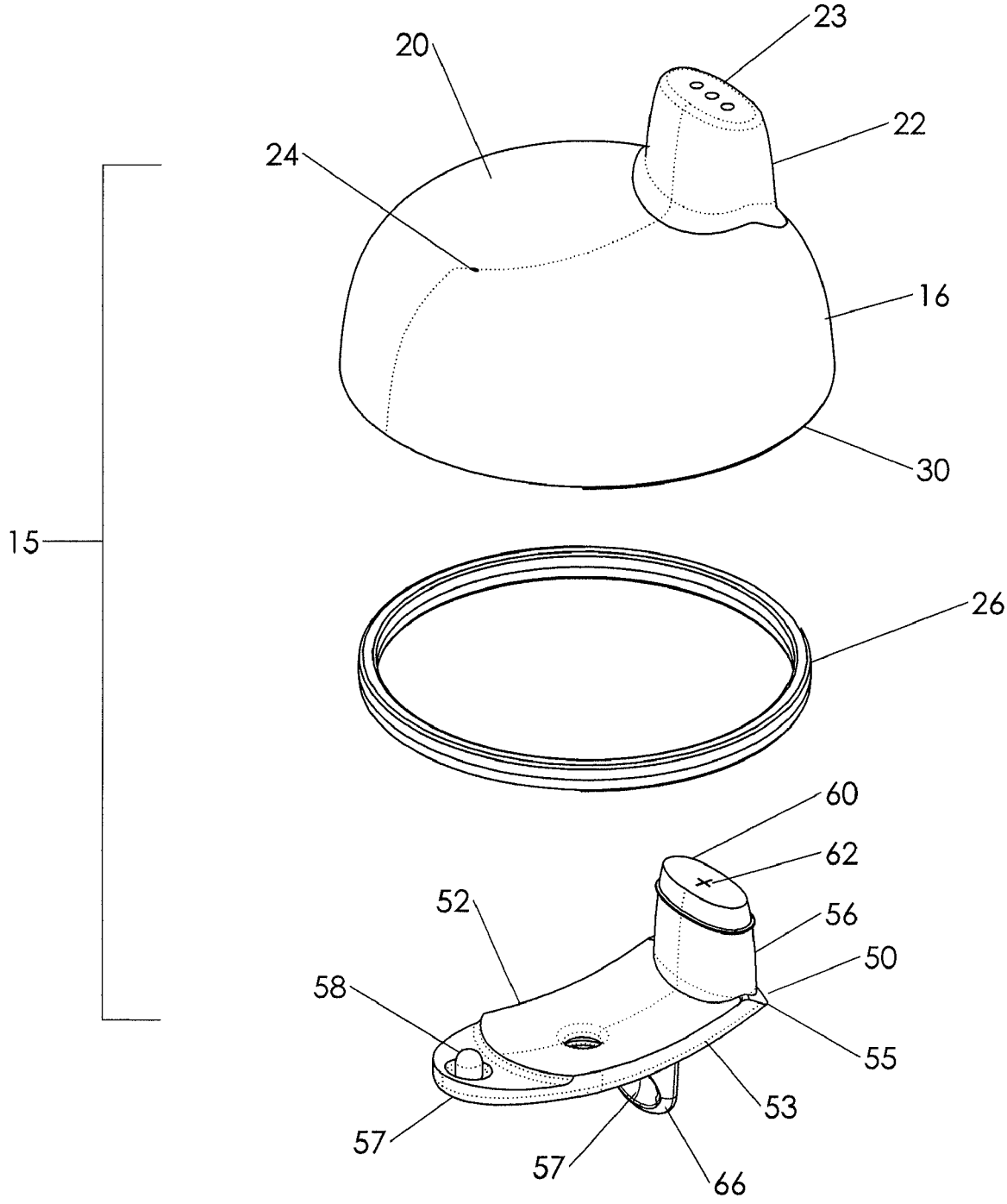
FIG. 4 is an exploded view of the lid assembly illustrated in FIGS. 2 and 3.

Specifically with regard to the lid assembly 15, illustrated in FIGS. 2-4, there is a lid 16 having an inner surface 18 and an outer surface 20. A spout 22 having formed therein at least one, but preferably a plurality of holes 23 extends from the outer surface 20 of the lid 16, the spout defining a corresponding inner cavity to facilitate the flow of a liquid from the container 12 to the user. As is known to those having skill in the art, and to counteract the buildup of negative pressure resulting from the suction applied by a user, the lid 16 further comprises an air exchange aperture 24 formed from the outer surface 20 through to the inner surface 18. As will be explained in greater detail, the air exchange aperture 24 permits the ingress of air from the atmosphere to the container 12 while a liquid flows from the container 12 to the mouth of the user through the spout 22.

In one embodiment, and as illustrated in FIGS. 3 and 4, the inner surface 18 of the lid 16 may comprise a circumferential mounting segment 30 on which a threading surface 32 is formed to releasably couple the lid 16 to an open end 14 of the container 12. Accordingly, the lid 16 may be screwed onto the container 12 to secure the lid 16 to the container 12, and similarly may be screwed off to permit washing of the components or refilling of a liquid in the container 12. Alternatively, the lid 16 may be friction fitted to the container 12, or each of the lid 16 and the container 12 may be provided with a variety of mating surfaces to otherwise couple the components and enclose the container 12. The lid 16 and the container 12 may be provided as a paired set, or the lid 16 may even be manufactured to accommodate a number of standard container sizes so to provide a retrofit lid assembly 15 to a container 12 separately purchased or owned by the user. The lid 16 is preferably composed of a semi-rigid material, such as polypropylene, by a method such as injection molding or blow molding, but other materials and methods may result in a similarly functional lid 16 having a spout 22 and air exchange aperture 24.

When the lid 16 is coupled to the open end 14 of the container 12, there is disposed between the container 12 and the inner surface 18 of the lid 16 an annular seal to prevent leakage of a liquid along a perimeter of the container 12. While it is preferred that the annular seal 26 may be installed in an appropriate mating surface formed in either the container 12 or the inner surface 18 of the lid 16, the annular seal 26 may also be secured to either component through alternate mechanical or chemical means known to those having ordinary skill in the art.

The annular seal 26, furthermore, may be permanently installed, or removable to facilitate the thorough cleaning of the lid assembly 15 and prevent buildup of contaminants between the annular seal 26 and either of the container 12 or the inner surface 18 of the lid. The annular seal 26 is preferably formed of a deformable and elastic material, such as silicone. Most importantly, the annular seal 26 should be constructed of a material capable of providing a liquid-tight seal to prevent liquid from permeating the connection point between the container 12 and the lid 16.

Within the inner surface 18 of the lid 16 is also situated a valve insert 50 to further provide a seal for preventing unwanted escape of a liquid from the container 12 through the lid 16. The valve insert 50 is depicted in detail in FIGS. 3-7. Most broadly, the valve insert 50 comprises a sheath 52 and a stabilizing core 54. The sheath 52 is characterized by a first rigidity, the stabilizing core 54 by a second rigidity, where the second rigidity is greater than the first rigidity. Particularly, the sheath 52 is formed over the stabilizing core 54 to at least partially encompass the relatively rigid stabilizing core 54. In a preferred embodiment, the valve insert 50 is formed through overmolding, thereby embedding the stabilizing core 54 within the sheath 52.

The stabilizing core 54 provides support to the less rigid sheath 52 for repeated removal and insertion of the valve insert 50 with respect to the lid 16. Not only does this construction of undergirding the sheath 52 with the stabilizing core 54 resist breakdown during removal and insertion, but also helps the valve insert 50 retain its shape during transport, storage, and repeated washings of the several sippy cup assembly 10 components. Additionally, the stabilizing core 54 prevents the sheath 52 from collapsing in response to the suction applied by a user to the spout 22.

Although the stabilizing core 54 and the sheath 52 may be formed in a variety of manners of a variety of materials, that the stabilizing core 54 have a greater rigidity than the sheath 52 is key. For example, it is provided that the sheath 52 may be formed of silicone for its liquid sealing capabilities, elasticity, and deformability, while the stabilizing core 54 may be formed of the more rigid nylon. Pairing a silicone sheath 52 with a nylon stabilizing core 54 produces a valve insert possessing the combined characteristics of flexibility—important, as will be explained, with respect to selectively permitting flow of a liquid—and rigidity—providing a convenient grasping point for the user while maintaining the shape and resisting tearing and unwanted deformation—in the aggregate, these components offer a valve insert 50 with the desirable qualities of durability, strength, operability, and washability, not otherwise offered by previously existing valve constructions. It is known to persons having ordinary skill in the art that a valve insert 50 comprising a sheath 52 and stabilizing core 54 constructed of comparable material will render similar results.

Figure 5:
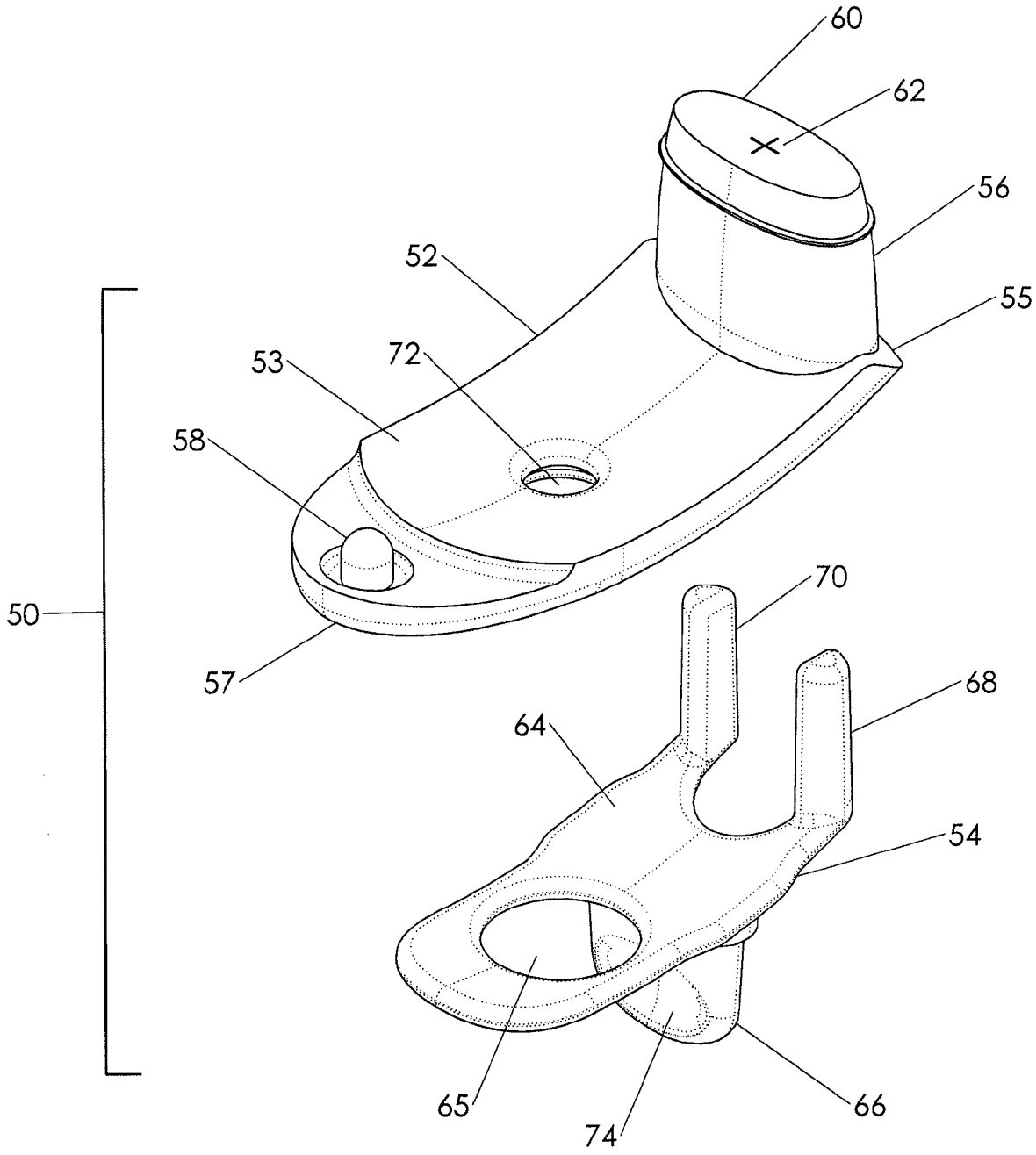
FIG. 5 is an exploded view of a valve insert as illustrated in the lid assembly embodiment depicted in FIG. 4.

Although other designs are envisioned, the embodiment of the valve insert 50 illustrated in FIG. 5 comprises a sheath 52 having an elongated connector 53 and a stabilizing core 54 having an elongated base 64 corresponding to the connector 53. With respect to the sheath 52, the connector 53 terminates in a proximal end 55 and a distal end 57. From the proximal end 55 extends an outflow port 56 having a valve face 60 into which a slit or plurality of slits 62 is formed. From the distal end 57 extends a stem 58 in the same direction as the outflow port 56. When installed in the lid 16, the outflow port 56 and the stem 58 correspond to the spout 22 and the air exchange aperture 24, respectively.

Accordingly, and as is known to those having ordinary skill in the art, when suction is applied to the spout 22 through the plurality of holes 23 by the user, thereby creating a negative pressure in the container 12, the slit 62 of the valve face 60 is responsive to the negative pressure, and permits liquid to flow out of the container 12 through the valve face 60. More specifically, the panels defined by the slit or plurality of slits 62 in the valve face 60 selectively displace to create a passageway through which liquid may flow upon suction. Simultaneously, upon suction the connector 53 permits the stem 58 to be displaced away from the air exchange aperture, thereby permitting the ingress of air from the atmosphere to the container 12 and creating equilibrium within the container 12 with respect to the external atmosphere.

By this cooperation between the valve face 50, and more specifically the slit 62, permitting egress of a liquid, and the stem 58 unblocking the air exchange aperture permitting ingress of air, the user is able to continue sipping from the sippy cup assembly 10 without the buildup of negative air pressure within the container 12 that would otherwise result in increasing difficulty and ultimate cessation of the flow of liquid. Similarly, however, the valve insert 50 prevents liquid from escaping when suction is not applied to the spout 22 because the slit 62 is disposed to block passage from the container 12 to the spout 22, as the stem 58 is disposed to block the air exchange aperture and, when properly installed, the lid assembly 15 includes no other openings through which liquid may escape.

Figure 6:
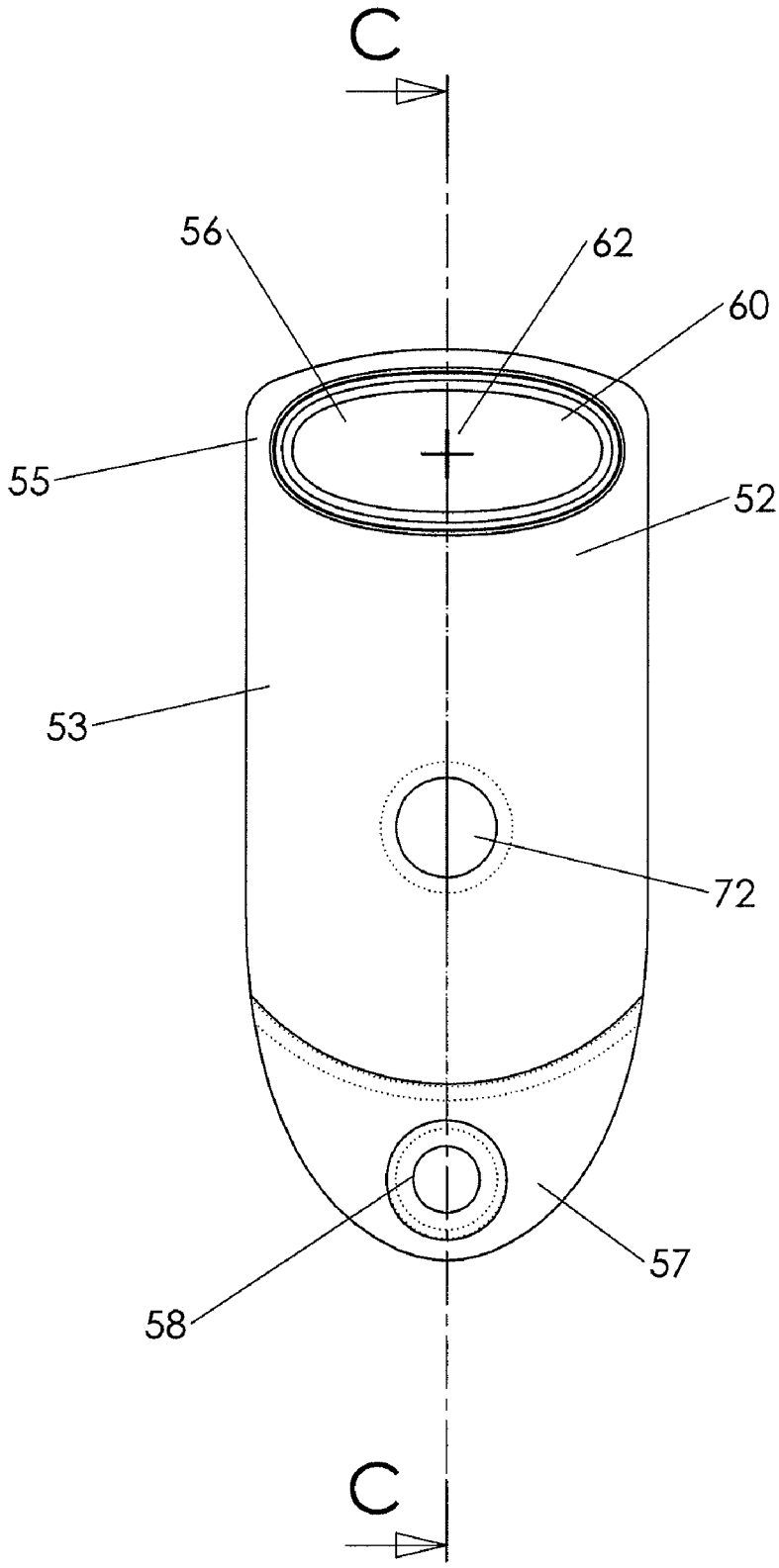
FIG. 6 is a top view of the valve insert of FIG. 5.
Figure 7:
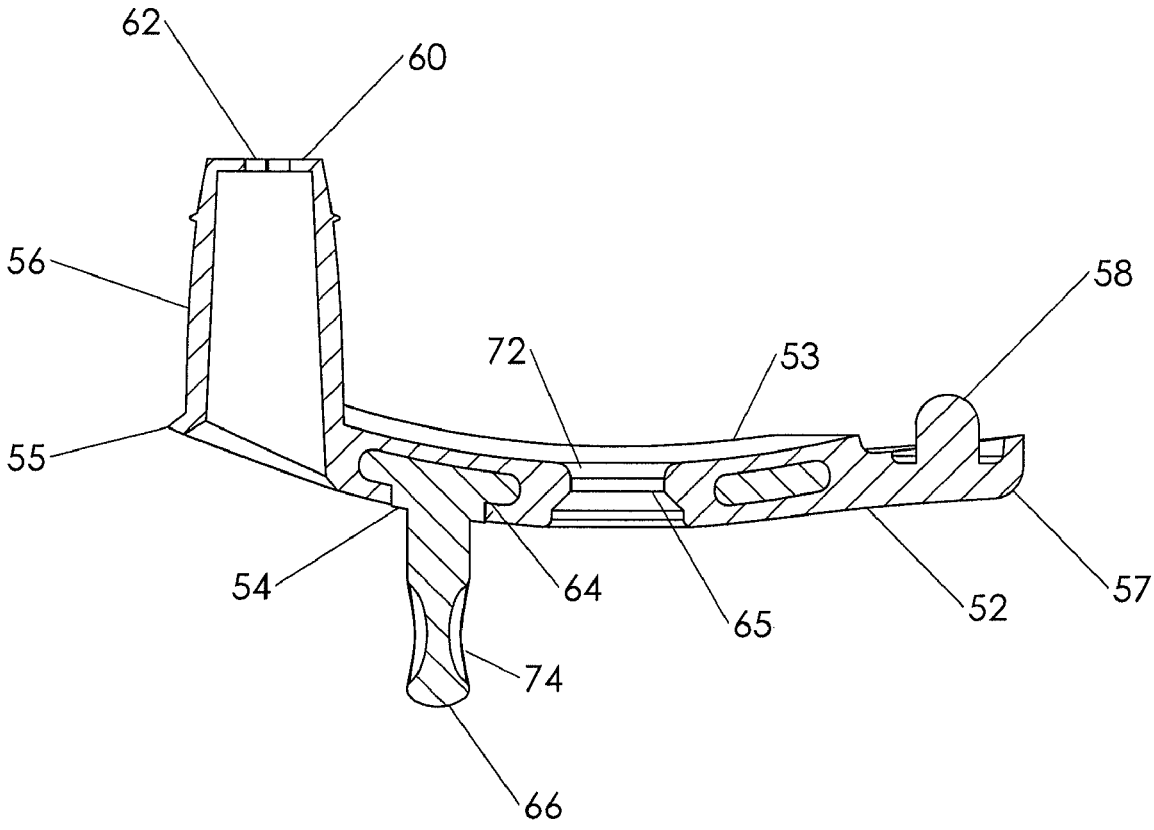
FIG. 7 is a cross-section of the valve insert of FIGS. 5 and 6 taken across line C-C.

With reference to FIGS. 5-7, and with regard specifically to the stabilizing core 54, an elongated base includes a tab 66 extending in a first direction for grasping by a user in removing and inserting the valve insert 50 with respect to the inner surface 18. The tab 66 may include a depression 74 to accommodate an average-sized finger to provide an ergonomic grasping surface. Additionally, first arm 68 and second arm 70 extend in a second direction opposite the first direction, the arms 68, 70 defining a space therebetween. The first arm 68 and the second arm 70 when cooperating with the sheath 52 are disposed in the outflow port 56 to add structure to opposing sides of the outflow port 56 and undergird the valve face 60. Accordingly, the disclosed sippy cup assembly 10 could be upturned without liquid passing through the closed slit 62 of the valve face 60 or the blocked air exchange aperture 24, but still permits easy suction by a child or an infirmed individual to obtain liquid, while even still preventing the outflow port 56 from collapsing upon application of that suction through provision of the first arm 68 and the second arm 70.

In one embodiment, the valve insert 50 may be removably secured to the inner surface 18 of the drink lid 16 by providing the inner surface 18 with a protuberance 28 and the valve insert 50 generally with a bore 72 for accepting the protuberance. In this embodiment, the stabilizing core 54 is provided with the base defining a passage 65 cooperating with the bore 72, such that the protuberance 28 may extend through both the sheath 52 and the stabilizing core 54. Alternatively, or in addition to a snapping engagement between the components, the valve insert may simply be retained in the inner surface 18 of the lid 16 through fitted engagement between the outflow port 56 and the inner cavity of the spout 22. Other securing means to retain the valve insert with respect to the lid 16 are also possible, as known to those having ordinary skill in the art.

Just as the lid assembly 15 may be manufactured as a retrofit to a range of existing container designs, the valve insert 50 may serve as a retrofit to existing sippy cup designs that presently lack the sealing capacities and durability of the disclosed design. In such an application, the elongated connector 53 of the sheath 52 and the placement of the spout 22 and the stem 58 may be designed to accommodate the large variety of sippy cup lids presently offered on the market.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A sippy cup assembly comprising:

a container having an open end;

a lid releasably coupled to the open end, the lid having an inner surface and an outer surface, a spout, and an air exchange aperture;

an annular seal disposed between the container and the inner surface when the lid is coupled to the open end; and a valve insert, the valve insert comprising:

a sheath having a first rigidity, wherein the sheath comprises an outflow port corresponding to the spout; and a stabilizing core having a second rigidity, the sheath being formed over the stabilizing core, wherein the stabilizing core comprises a first arm and second arm disposed within the outflow port;

wherein the second rigidity is greater than the first rigidity.

2. The sippy cup assembly of claim 1, wherein the sheath comprises a stem corresponding to the air exchange aperture, the outflow port comprising a valve face having a slit.

3. The sippy cup assembly of claim 1, wherein the stabilizing core comprises a base and a tab extending in a first direction from the base, wherein the first arm and the second arm extend from the base in a second direction opposite the first direction.

4. The sippy cup assembly of claim 2, wherein the slit and the stem are responsive to a negative pressure within the container for permitting egress of a liquid and ingress of air.

5. The sippy cup assembly of claim 1, wherein the stabilizing core is embedded in the sheath.

6. The sippy cup assembly of claim 5, wherein the stabilizing core is embedded in the sheath by overmolding.

7. The sippy cup assembly of claim 1, wherein the sheath is silicone.

8. The sippy cup assembly of claim 1, wherein the stabilizing core is nylon.

9. The sippy cup assembly of claim 1, wherein the annular seal is silicone.

10. The sippy cup assembly of claim 1, wherein the lid is polypropylene.

11. The sippy cup assembly of claim 1, wherein the inner surface includes a protuberance and the valve insert further comprises a bore for accepting the protuberance to secure the valve insert to the inner surface.

12. The sippy cup assembly of claim 3, wherein the tab comprises a depression for grasping by a user to remove the valve insert from the inner surface.

13. A sippy cup valve insert, the valve insert comprising:

a sheath having a first rigidity, wherein the sheath includes an elongated connector, wherein the connector terminates in a proximal end and a distal end, an outflow port extends from the proximal end; and a stabilizing core having a second rigidity greater than the first rigidity, the stabilizing core includes an elongated base corresponding to the connector, the sheath being formed over the stabilizing core such that the base of the stabilizing core is embedded in the sheath by overmolding.

14. The sippy cup valve insert of claim 13, wherein the sheath comprises a stem extending from the distal end of the connector.

15. The sippy cup valve insert of claim 13, wherein the stabilizing core comprises a tab extending in a first direction from the base, and a first arm and second arm extending in a second direction opposite the first direction, the first arm and second arm being disposed within the outflow port.

16. The sippy cup valve insert of claim 14, wherein the outflow port comprises a valve face having a slit, the slit and the stem being responsive to a negative pressure for permitting egress of a liquid and ingress of air.

17. The sippy cup valve insert of claim 13, wherein the elongated base includes an upper surface and a lower surface, wherein the upper surface and the lower surface are each covered by the sheath.

18. The sippy cup valve insert of claim 17, wherein the stabilizing core comprises a tab extending in a first direction from the lower surface of the elongated base, and a first arm and second arm extending in a second direction, opposite the first direction, from the upper surface of the elongated base, the first arm and second arm being disposed within the outflow port and the tab not being covered by the sheath.

19. A sippy cup assembly comprising:

a container having an open end;

a lid releasably coupled to the open end, the lid having an inner surface and an outer surface, and a spout; and the valve insert of claim 13, wherein the outflow port of the sheath is received in the spout when the valve insert is installed in the lid.

20. The sippy sup assembly of claim 19, wherein the lid includes a protuberance on the inner surface of the lid, wherein the elongated connector of the sheath defines a bore corresponding to the protuberance, wherein the elongated base of the stabilizing core defines a passage corresponding to the bore, wherein the valve insert is retained against the inner surface by receiving the protuberance in the bore.

21. A sippy cup lid assembly, comprising:

a polypropylene lid having an inner surface and an outer surface, the inner surface comprising a protuberance and a mounting segment having a threading surface formed thereon, the outer surface comprising a spout extending therefrom in which a plurality of holes are formed and an air exchange aperture;

a silicone annular seal disposed on the inner surface near the mounting segment;

a valve insert comprising:

a silicone sheath having an elongated connector defining a bore corresponding to the protuberance, a proximal end from which an outflow port extends in fluid communication with the spout, and a distal end from which a stem extends for cooperation with the air exchange aperture; and a nylon stabilizing core disposed within the silicone sheath, the nylon stabilizing core having a base defining a passage corresponding to the bore, a tab having a depression extending in a first direction from the base, and a first arm and second arm extending in a second direction opposite the first direction disposed in the outflow port;

wherein the valve insert is retained in the inner surface by disposing the bore on the protuberance, and the outflow port comprises a valve face having at least one slit, the slit and the stem being responsive to a suction such that the slit permits outflow through the plurality of holes and the connector flexes the stem away from the air exchange aperture for permitting inflow of air.

* * * * *